US005304891A

United States Patent [19]

Otsuka

[11] Patent Number: 5,304,891

[45] Date of Patent: Apr. 19, 1994

[54] CATHODE-RAY TUBE DISPLAY DEVICE

[75] Inventor: Hiroshi Otsuka, Nagasaki, Japan

[73] Assignee: Mitsubishi Denki Kabushiki Kaisha, Tokyo, Japan

[21] Appl. No.: 888,121

[22] Filed: May 26, 1992

[30] Foreign Application Priority Data

Jun. 28, 1991 [JP] Japan ..... 3-184056

[51] Int. Cl.[5] ..... H01J 31/00

[52] U.S. Cl. ..... 313/479; 313/313; 313/440; 335/214; 348/818

[58] Field of Search ..... 313/479, 242, 313, 348, 313/356, 440; 174/35 MS; 358/254; 335/214

[56] References Cited

U.S. PATENT DOCUMENTS

| | | | |
|---|---|---|---|
| 2,343,630 | 3/1944 | Atwood | 313/479 |
| 3,443,138 | 5/1969 | Schwartz | 313/479 |
| 3,562,518 | 2/1971 | Javorik | 313/479 X |
| 4,217,521 | 8/1980 | Dietch et al. | 313/479 |
| 4,853,790 | 8/1989 | Dickie | 313/479 X |
| 5,105,120 | 4/1992 | Nishioka et al. | 313/440 |

FOREIGN PATENT DOCUMENTS

| | | | |
|---|---|---|---|
| 0427182 | 5/1991 | European Pat. Off. | 313/440 |
| 62-193039 | 8/1987 | Japan . | |
| 64-72444 | 3/1989 | Japan . | |
| 0249036 | 9/1992 | Japan | 313/479 |
| 309701 | 9/1955 | Switzerland . | |

OTHER PUBLICATIONS

IBM Technical Disclosure Bulletin, vol. 21, No. 5, Oct. 1978, J. A. Harder et al.

*Primary Examiner*—Donald J. Yusko
*Assistant Examiner*—Ashok Patel
*Attorney, Agent, or Firm*—Burns, Doane, Swecker & Mathis

[57] ABSTRACT

A cathode-ray tube display device wherein a resistance material, e.g. graphite, is provided on each of a funnel portion, a cone portion and a neck portion of a cathode-ray tube, and a deflecting coil unit is mounted to the neck portion through an insulator, to shield an alternating electric field generated from the deflecting coil unit.

15 Claims, 5 Drawing Sheets

CATHODE-RAY TUBE DISPLAY DEVICE

BACKGROUND OF THE INVENTION

1. Field of the Invention

The present invention relates to a cathode-ray tube display device which displays images using a cathode-ray tube.

2. Description of the Prior Art

FIG. 1 is an exploded perspective view of a principal portion of a conventional cathode-ray tube display device disclosed, for example, in Swiss Patent No. 309701. In the same figure, the reference numeral 1 denotes a cathode-ray tube (hereinafter referred to as "CRT"); the numeral 2 denotes a deflecting coil unit mounted to a neck portion of the CRT 1; numeral 3 denotes a circuit board mounted to the deflecting coil unit; numeral 4 denotes a lead wire drawn out from the circuit board 3; numeral 5 denotes a connector connected to the lead wire; numeral 6 denotes a metallic reinforcing band for explosion-proof wound round a panel portion 1*a* of the CRT 1; numeral 7 denotes a cabinet which houses therein substantially the whole of the device; and numeral 8 denotes a front cover which encloses therein the panel portion 1*a* of the CRT 1.

Referring to FIG. 2, which is a side view of the CRT 1, the numeral 1*b* denotes a funnel portion body other than the panel portion 1*a*, the panel portion body 1*b* being divided into a funnel portion 1*c*, a cone portion 1*d* and a neck portion 1*e*. Numeral 9 denotes an electron gun disposed in the interior of the neck portion 1*e*; numeral 11 denotes an anode button provided in the funnel portion 1*c*; and numeral 12 denotes a resistance material, e.g. graphite, applied to the funnel portion 1*c* for imparting capacitance to the CRT 1. The panel portion 1*a* and the funnel portion 1*c* are sealed and bonded together using fritted glass, and the reinforcing band 6 is wound round a boundary portion between the two.

In FIG. 3, which is a perspective view of the deflecting coil unit 2, the numeral 13 denotes a coil mounting body constituted by a trumpet-shaped insulator; numeral 14 denotes a vertical deflecting coil mounted on the outer peripheral surface of the coil mounting body 13; and numeral 15 denotes a horizontal deflecting coil mounted on the inner peripheral surface of the coil mounting body 13. The deflecting coil unit 2 of such a construction is mounted on the neck portion 1*e* of the CRT 1, as shown in FIG. 1, and a front end portion thereof is in contact with the cone portion 1*d*.

FIGS. 4 and 5 are a perspective view and a sectional side view, respectively, showing a horizontal width adjusting coil unit, in which the numeral 16 denotes a horizontal width adjusting coil unit; numeral 17 denotes a coil bobbin; numeral 18 denotes a coil wound round the coil bobbin 17; and numeral 19 denotes a screw core for inductance adjustment which is movable vertically in the interior of the coil 18. The horizontal width adjusting coil unit 16 of such a construction is used in connection with a fly-back transformer (not shown).

The operation of such conventional cathode-ray tube display device will be described below.

A vertical deflecting current and a horizontal deflecting current are fed to the vertical deflecting coil 14 and the horizontal deflecting coil 15 of the deflecting coil unit 2, and a video signal is fed to the electron gun 9, whereby an electron beam from the electron gun 9 is deflected. This electron beam is radiated to a phosphor of R.G.B. applied to the surface of the panel portion 1*a*, whereby the panel surface is rendered luminous and an image is displayed thereon. By adjusting the screw core 19 of the horizontal width adjusting coil unit 16, the horizontal width of the screen is adjusted.

Since the conventional cathode-ray tube display device is constructed as above, an alternating electric current is generated from the coils and transformers of the deflecting coil unit 2 and the horizontal width adjusting coil unit 16 and sometimes the leakage thereof to the exterior affects the peripheral devices. Recently, a standard for restricting the generation of such alternating electric field has been established, so there arose the necessity of taking some measures to meet the standard. In this connection, there has been proposed a method in which a resistance material is provided on the tube surface and is connected to ground to shield electrostatically the alternating electric field leaking in the tube axis direction from the deflecting coil unit 2. However, a satisfactory effect has not been obtained yet.

SUMMARY OF THE INVENTION

The present invention has been accomplished for solving the above-mentioned problem.

It is an object of the present invention to provide a cathode-ray tube display device having the function of electrostatically shielding an alternating electric field generated from a deflecting coil device and other coils and transformers.

It is another object of the present invention to provide a cathode-ray tube display device which is neither complicated nor expensive, is far superior in accuracy and performance to the existing like devices and is capable of diminishing the leaking alternate electric field in a simple and inexpensive manner.

In order to achieve the above-mentioned objects, according to a first aspect of the present invention there is provided a cathode-ray tube display device wherein the resistance material such as graphite heretofore provided over the funnel portion is also provided on the cone portion up to a part of the neck portion, and a deflecting coil unit is mounted through an insulator.

According to a second aspect of the present invention there is provided a cathode-ray tube display device wherein a resistance material is provided on the inner surfaces of both or one of a cabinet and a front cover.

According to a third aspect of the present invention there is provided a cathode-ray tube display device wherein a resistance material is provided on the inner surface of a deflecting coil unit through an insulator.

According to a fourth aspect of the present invention there is provided a cathode-ray tube display device wherein a resistance material is provided on the outer surface of a deflecting coil unit through an insulator.

Further, according to a fifth aspect of the present invention there is provided a cathode-ray tube display device wherein the peripheral edge portion of the tube surface is covered with a wide reinforcing band.

The above and other objects and novel features of the present invention will become more apparent from a reading of the following detailed description taken in connection with the accompanying drawings. It is to be understood, however, that the drawings are for the purpose of illustration only and is not intended to restrict the scope of the invention.

DETAILED DESCRIPTION OF THE PREFERRED EMBODIMENTS

Preferred embodiments of the present invention will be described in detail hereinunder with reference to the accompanying drawings.

Embodiment 1

Figure 2:
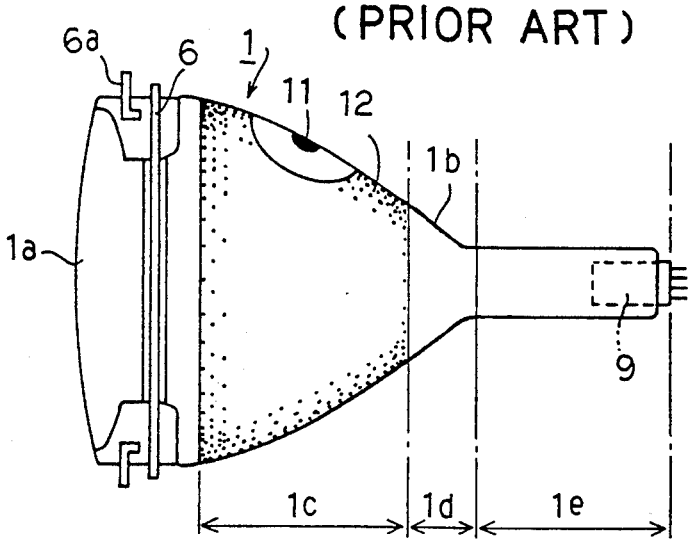
FIG. 2 (PRIOR ART)
FIG. 2 is a side view of a cathode-ray tube used in the conventional cathode-ray tube display device.
Figure 3:
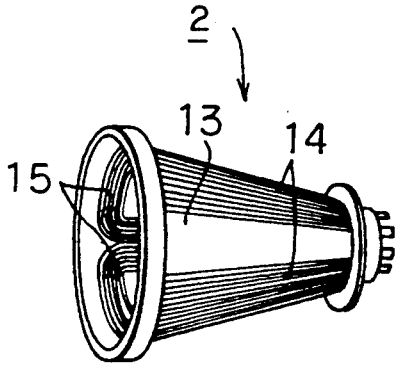
FIG. 3 (PRIOR ART)
FIG. 3 is a perspective view of a deflecting coil unit used in the conventional cathode-ray tube display device.
Figure 4:
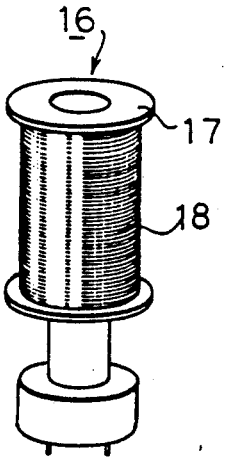
FIG. 4 (PRIOR ART)
FIG. 4 is a perspective view of a horizontal width adjusting coil unit used in the conventional cathode-ray tube display device.
Figure 5:
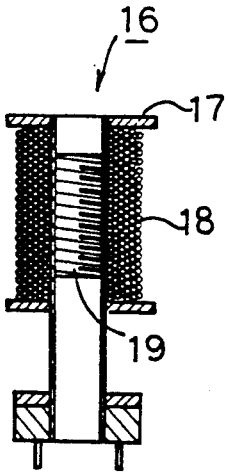
FIG. 5 (PRIOR ART)
FIG. 5 is a sectional side view of the horizontal width adjusting coil unit used in the conventional cathode-ray tube display device.

An embodiment in the first aspect of the present invention will be described below with reference to FIGS. 6 and 7, in which the portions corresponding to those in FIGS. 2 and 3 are indicated by the same reference numerals and explanations thereof will be omitted.

Figure 6:
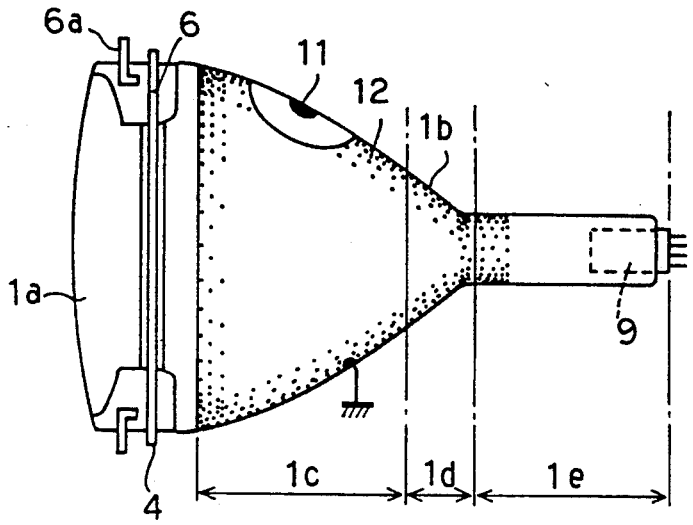
FIG. 6 is a side view of a cathode-ray tube used in a cathode-ray tube display device according to an embodiment in the first aspect of the present invention.

In FIG. 6, the numeral 12 denotes a resistance material, e.g. graphite, which is applied continuously to a funnel portion 1*c*, a cone portion 1*d* and part of a neck portion 1*e* and is connected to ground. In the prior art, the resistance material 12 is applied to only the funnel portion 1*c* as in FIG. 2.

Figure 7:
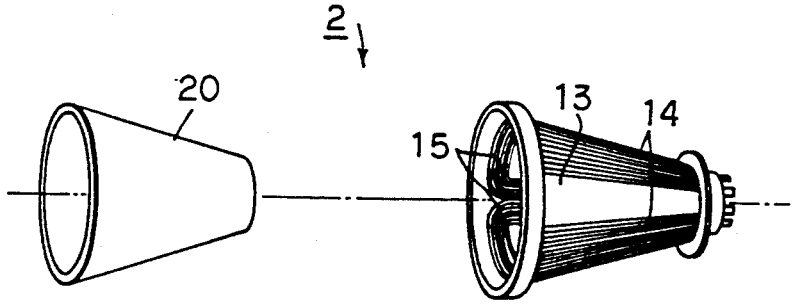
FIG. 7 is a perspective view of a deflecting coil unit used in the cathode-ray tube display device shown in FIG. 6.

In FIG. 7, the numeral 20 denotes a trumpet-shaped insulator, which is inserted inside a deflecting coil 2.

The operation of this embodiment will now be described. Once the deflecting coil unit 2 with the trumpet-shaped insulator 20 in FIG. 7 inserted therein is mounted to the neck portion le of a CRT 1 shown in FIG. 6, a vertical deflecting coil 14 and a horizontal deflecting coil 15 of the deflecting coil unit 2 are partially brought into contact with the resistance material 12 on the cone portion 1*d* and neck portion 1*e*, whereby an alternating electric field generated from each of those coils is shielded electrostatically. Further, since the horizontal deflecting coil 15 is in contact with the resistance material 12 through the insulator 20, an electrical insulation is guaranteed even when there are pin holes in the insulating films of the coils constituted by enameled wires for example.

Embodiment 2

Figure 1:
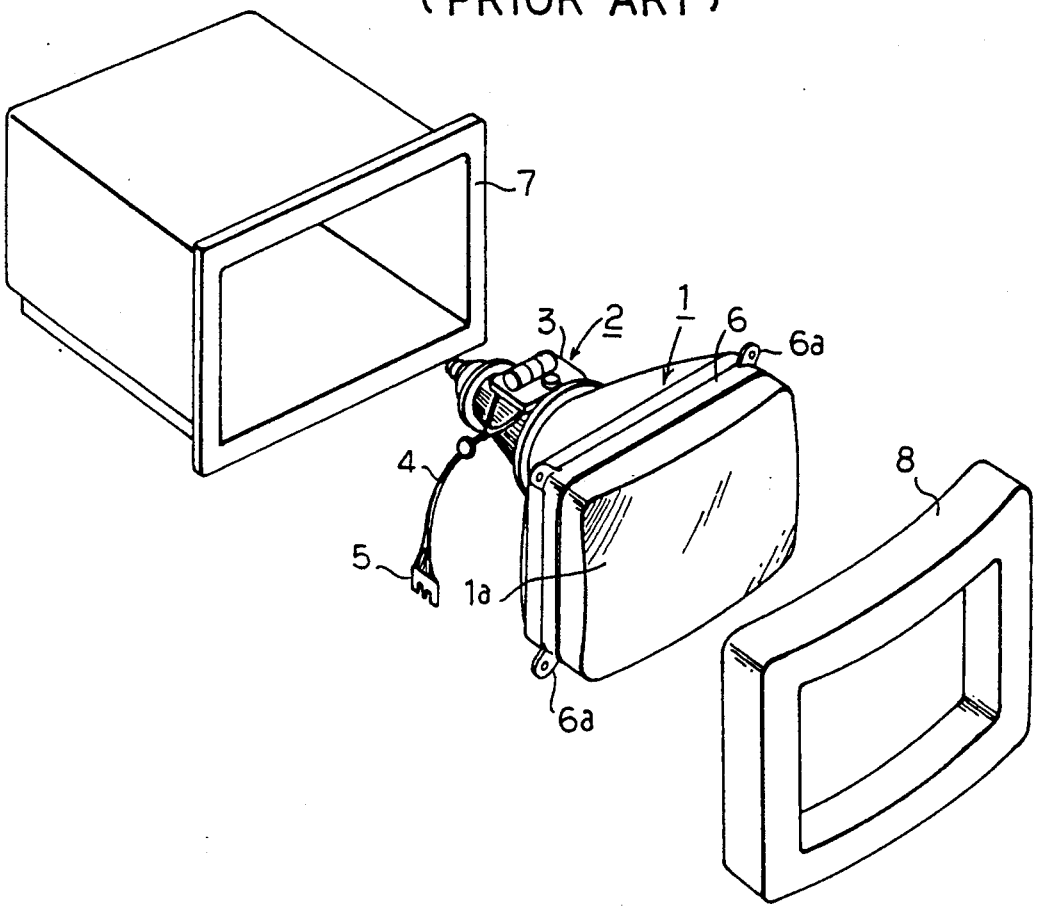
FIG. 1 (PRIOR ART)
FIG. 1 is an exploded perspective view of a principal portion of a conventional cathode-ray tube display device.
Figure 8:
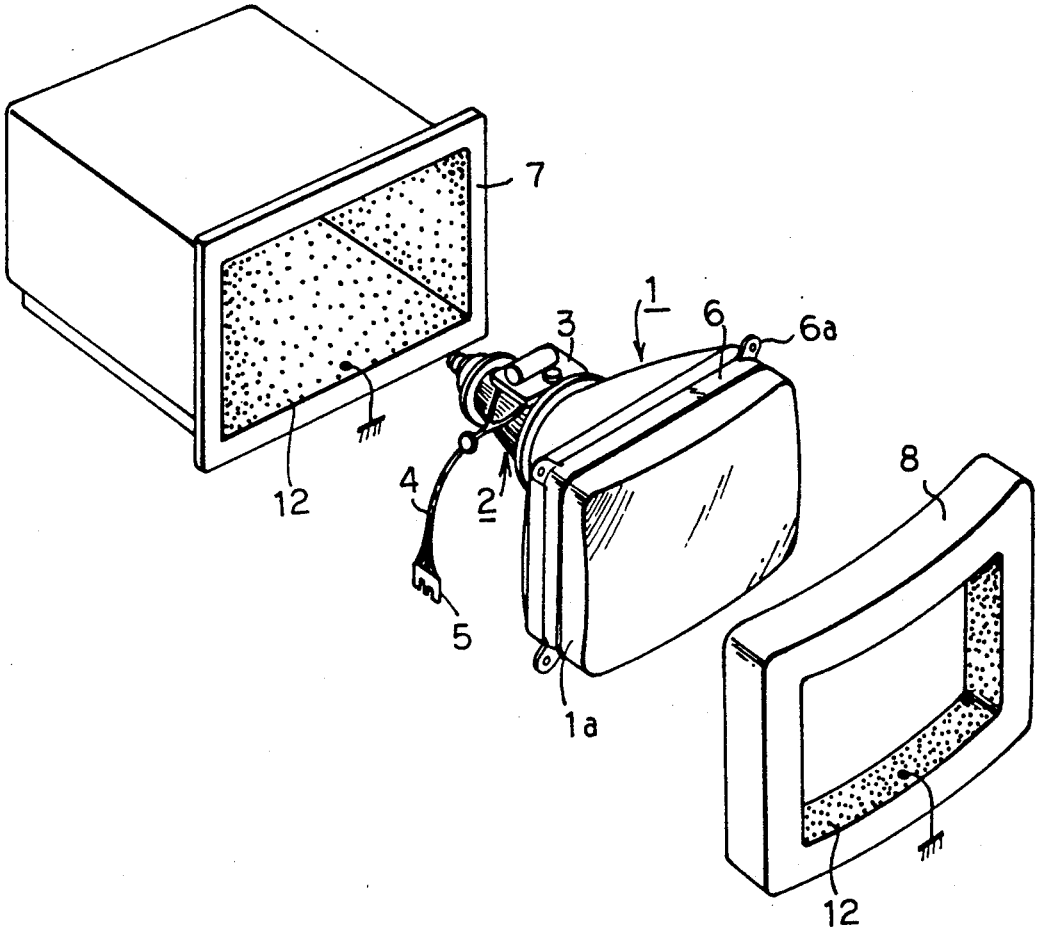
FIG. 8 is an exploded perspective view of a principal portion of a cathode-ray tube display device according to an embodiment in the second aspect of the present invention.

FIG. 8 illustrates an embodiment in the second aspect of the present invention, in which the portions corresponding to those in FIG. 1 are indicated by the same reference numerals.

In this embodiment 2, a resistance material 12 is provided on both the inner surface of a cabinet 7 and that of a front cover 8 and is connected to ground.

According to the embodiment 2, an alternating electric field generated from each of a deflecting coil device 2 and other coils and transformers is shielded electrostatically, whereby the alternating electric field leaking from the entire cathode-ray tube display device can be diminished.

Although in this embodiment 2 the resistance material is applied to both the cabinet 7 and the front cover 8, it may be provided on either one. Further, this embodiment may be applied in combination with the CRT 1 shown in FIG. 6.

Embodiment 3

Figure 9:
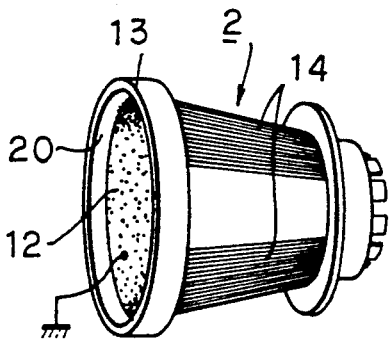
FIG. 9 is a perspective view of a deflecting coil used in a cathode-ray tube display device according to an embodiment in the third aspect of the present invention.

FIG. 9 illustrates an embodiment in the third aspect of the present invention, in which an insulator 20 is provided inside a deflecting coil unit 2, and a resistance material 12 is provided on the inner surface of the insulator 20.

Embodiment 4

Figure 10:
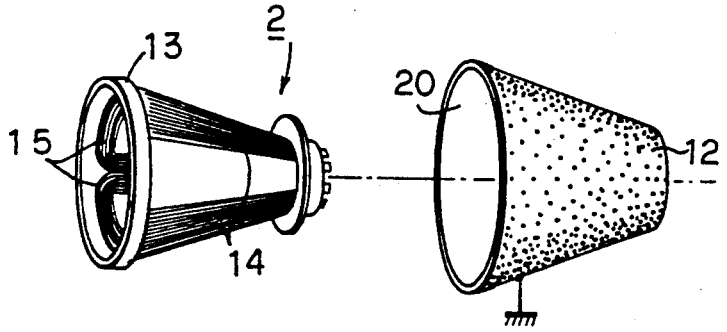
FIG. 10 is a perspective view of a deflecting coil unit used in a cathode-ray tube display device according to an embodiment in the fourth aspect of the present invention.

FIG. 10 illustrates an embodiment in the fourth aspect of the present invention, in which a trumpet-shaped insulator 20 is provided outside a deflecting coil unit 2, and a resistance material 12 is applied to the outer surface of the insulator 20.

By attaching the deflecting coil unit 2 shown in FIGS. 9 and 10 to the CRT 1 shown in FIG. 2 and connecting the resistance material 12 to ground, there can be obtained an electric field shielding effect for the deflecting coil unit 2.

Embodiment 5

Figure 11:
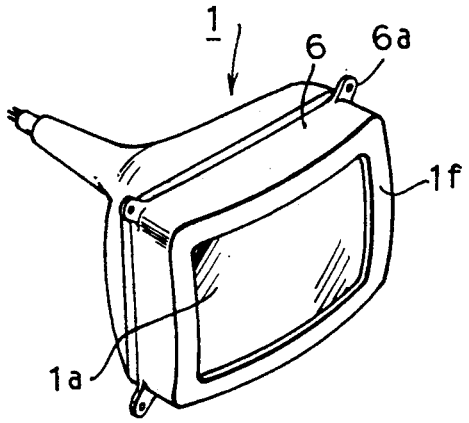
FIG. 11 is a perspective view of a cathode-ray tube display device according to an embodiment in the fifth aspect of the invention.

FIG. 11 illustrates an embodiment in the fifth aspect of the present invention, in which there is used a sufficiently wide, reinforcing band 6 made of a metal to cover not only the peripheral surface of a panel portion 1*a* but also a peripheral edge portion 1*f* of the tube surface.

By such construction there can be obtained an electric field shielding effect in the axial direction of a CRT 1.

Embodiment 6

Figure 12:
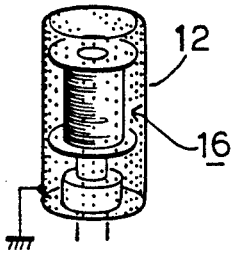
FIG. 12 is a perspective view of a horizontal width adjusting coil unit used in a cathode-ray tube display device further embodying the present invention.

FIG. 12 illustrates an embodiment in which the foregoing horizontal width adjusting coil unit 16 is to be shielded electrostatically. The coil unit 16 is shielded with a resistance material 12 such as a metallic case for example. This method using a metallic case is applicable to other coils and transformers.

Thus, according to the first, third and fourth aspects of the present invention, an alternating electric field generated from the deflecting coil unit can be effectively shielded electrostatically.

According to the second aspect of the present invention, an alternating electric field generated from each of the deflecting coils and other coils and transformers is shielded and so an alternating electric field leaking from the entire cathode-ray tube display device can be diminished.

Further, according to the third aspect of the present invention, it is possible to diminish the alternating electric field leaking in the axial direction of the cathode-ray tube.

What is claimed is:

1. A cathode-ray tube display device wherein an electron beam emitted from an electron gun provided in the interior of a neck portion of a cathode-ray tube comprising a panel portion, a funnel portion, a cone portion, and said neck portion, is deflected in at least one direction by means of an electrostatic deflection type deflecting coil unit disposed exteriorly near said neck portion and is then radiated to a fluorescent screen of said panel portion to render the fluorescent screen luminous for the display of images, said cathode-ray tube display device comprising:

a resistance material provided continuously on outer surfaces of said funnel portion, cone portion and neck portion; and an insulator provided between an inner surface of said deflecting coil unit and said neck portion.

2. The cathode-ray tube display device of claim 1, wherein said at least one direction is a vertical direction.

3. The cathode-ray tube display device of claim 1, wherein said at least one direction is a horizontal direction.

4. A cathode-ray tube display device wherein an electron beam emitted from an electron gun provided in the interior or a neck portion of a cathode-ray tube comprising a panel portion, a funnel portion, a cone portion, and said neck portion, is deflected in at least one direction by means of an electrostatic deflection type deflecting coil unit disposed exteriorly near said neck portion and is then radiated to a fluorescent screen of said panel portion to render the fluorescent screen luminous for the display of images, said cathode-ray tube display device comprising:

a resistance material provided on an inner surface of a cabinet which houses therein the neck, funnel and cone portion.

5. The cathode-ray tube display device of claim 4, wherein said at least one direction is a vertical direction.

6. The cathode-ray tube display device of claim 4, wherein said at least one direction is a horizontal direction.

7. A cathode-ray tube display device wherein an electron beam emitted from an electron gun provided in the interior of a neck portion of a cathode-ray tube comprising a panel portion, a funnel portion, a cone portion, and said neck portion, is deflected in at least one direction by means of an electrostatic deflection type deflecting coil unit disposed exteriorly near said neck portion and is then radiated to a fluorescent screen of said panel portion to render the fluorescent screen luminous for the display of images, said cathode-ray tube display device comprising:

an insulator provided between an inner surface of said deflecting coil unit and said neck portion; and a resistance material provided on an inner surface of said insulator.

8. The cathode-ray tube display device of claim 7, wherein said at least one direction is a vertical direction.

9. The cathode-ray tube display device of claim 7, wherein said at least one direction is a horizontal direction.

10. A cathode-ray tube display device wherein an electron beam emitted from an electron gun provided in the interior of a neck portion of a cathode-ray tube comprising a panel portion, a funnel portion, a cone portion, and said neck portion, is deflected in at least one direction by means of an electrostatic deflection type deflecting coil unit disposed exteriorly near said neck portion and is then radiated to a fluorescent screen of said panel portion to render the fluorescent screen luminous for the display of images, said cathode-ray tube display device comprising:

an insulator provided outside around an outer surface of said deflecting coil unit; and a resistance material provided on an outer surface of said insulator.

11. The cathode-ray tube display device of claim 10, wherein said at least one direction is a vertical direction.

12. The cathode-ray tube display device of claim 10, wherein said at least one direction is a horizontal direction.

13. A cathode-ray tube display device wherein an electron beam emitted from an electron gun provided in the interior or a neck portion of a cathode-ray tube comprising a panel portion, a funnel portion, a cone portion, and said neck portion, is deflected in at least one direction by means of an electrostatic deflection type deflecting coil unit disposed exteriorly near said neck portion and is then radiated to a fluorescent screen of said panel portion to render the fluorescent screen luminous for the display of images, said cathode-ray tube display device comprising:

a resistance material provided on an inner surface of a cabinet which houses therein an inner surface of a front cover in which is enclosed said panel portion.

14. The cathode-ray tube display device of claim 13, wherein said at least one direction is a vertical direction.

15. The cathode-ray tube display device of claim 13, wherein said at least one direction is a horizontal direction.

* * * * *